US008499577B2

(12) United States Patent
Watson et al.

(10) Patent No.: US 8,499,577 B2
(45) Date of Patent: Aug. 6, 2013

(54) ICE MAKING AND WATER DELIVERY APPARATUS

(75) Inventors: Eric K. Watson, Crestwood, KY (US); Omar Haidar, Louisville, KY (US); Kenneth U. Nsofor, Louisville, KY (US); Matthew William Davis, Prospect, KY (US); Ronald Scott Tarr, Louisville, KY (US); Joseph Waugh, Louisville, KY (US)

(73) Assignee: General Electric Company, Schenectady, NY (US)

( * ) Notice: Subject to any disclaimer, the term of this patent is extended or adjusted under 35 U.S.C. 154(b) by 901 days.

(21) Appl. No.: 12/333,749

(22) Filed: Dec. 12, 2008

(65) Prior Publication Data

US 2010/0147008 A1 Jun. 17, 2010

(51) Int. Cl.
*F25C 1/24* (2006.01)
*F25C 1/22* (2006.01)

(52) U.S. Cl.
USPC ..... 62/340

(58) Field of Classification Search
USPC ..... 62/340, 337, 338, 353, 354
See application file for complete search history.

(56) References Cited

U.S. PATENT DOCUMENTS

| | | | | |
|---|---|---|---|---|
| 3,429,140 | A * | 2/1969 | White | 62/339 |
| 6,460,367 | B1 * | 10/2002 | DuHack | 62/337 |
| 6,613,236 | B1 * | 9/2003 | Guess et al. | 210/739 |
| 6,973,803 | B2 * | 12/2005 | Olive et al. | 62/338 |
| 2002/0020181 | A1 * | 2/2002 | Ewert et al. | 62/228.4 |
| 2006/0086107 | A1 * | 4/2006 | Voglewede et al. | 62/135 |
| 2006/0196213 | A1 * | 9/2006 | Anderson | 62/344 |
| 2006/0266056 | A1 * | 11/2006 | Chang | 62/135 |
| 2007/0119193 | A1 * | 5/2007 | Davis et al. | 62/135 |

* cited by examiner

*Primary Examiner* — Ljiljana Ciric
*Assistant Examiner* — Alexis Cox
(74) *Attorney, Agent, or Firm* — Global Patent Operation; Douglas D. Zhang

(57) ABSTRACT

An ice making apparatus for a refrigerator is disclosed. The apparatus includes an ice making compartment; an icemaker disposed in the ice making compartment and including an ice mold body, the ice mold body defining therein a plurality of ice cavities for containing water therein for freezing into ice cubes, and a channel for transport of a working medium, the channel having an outlet; and a temperature sensor disposed in the ice making compartment and adjacent the outlet.

20 Claims, 8 Drawing Sheets

ICE MAKING AND WATER DELIVERY APPARATUS

BACKGROUND OF THE INVENTION

The present invention relates generally to refrigerators, and more specifically, to locations of elements and apparatus involved with making ice and delivering water throughout a refrigerator.

Generally, a refrigerator includes a freezer compartment and a fresh food compartment which are partitioned from each other to store various foods at low temperatures in appropriate states for a relatively long time.

It is now common practice in the art of refrigerators to provide an automatic icemaker to increase the speed of the ice-making operation. In a "side-by-side" type refrigerator where the freezer compartment is arranged to the side of the fresh food compartment, the icemaker is usually disposed in the freezer compartment and delivers ice through an opening in the access door of the freezer compartment. In this arrangement, ice is formed by freezing water with cold air in the freezer compartment, the air being made cold by the cooling system or circuit of the refrigerator including an evaporator. In a "bottom freezer" type refrigerator where the freezer compartment is arranged below a top fresh food compartment, convenience necessitates that the icemaker be disposed in the access door of the top mounted fresh food compartment and deliver ice through an opening in the access door of the fresh food compartment, rather than through the access door of the freezer compartment. In this case, for example, cold air, which is cooled by the evaporator of a cooling system, is delivered through an interior channel of the access door of the fresh food compartment to the icemaker to maintain the icemaker at a temperature below the freezing point of water.

Location of the icemaker within the fresh food compartment presents many new challenges not previously encountered. The ice making compartment needs to be kept at a lower temperature than the fresh food compartment for making and storing of ice. Water must be delivered to the icemaker, which has fewer options of conveyance for tubing than a stationary icemaker within a conventional freezer. This configuration, of the icemaker being in the fresh food compartment, incurs others disadvantages, which include, structural complexity of the access door of the fresh food compartment because of the formation of cold air channels in the door, and difficulty to keep the evaporator air cold when it is delivered to the icemaker because of the distance it must travel. As a result, the manufacturing cost of the refrigerator may be increased, and the rate at which ice can be made may be reduced.

Temperature control within the ice making compartment during ice storage and production is an important control limitation. Heat sources within the ice making compartment should be reduced to a minimum, making maintenance and monitoring of temperatures within the compartment a priority.

With many new refrigerators the access door not only contains the ice making compartment, it also may have a drinking water delivery system for a user to access from the outside of the refrigerator. Typically to supply both the ice making compartment and the drinking water delivery system, two separate delivery lines would have to extend between the refrigerator body/chassis and the access door. This requirement for two separate delivery lines poses a problem because of the limited space available in the supporting hinges which secure the access door, through which delivery lines typically pass.

Therefore, it would be desirable to provide an accurate temperature reading for efficient ice production and storage, reduce heat sources within an ice making compartment, and reduce the number of water delivery lines passing through the supporting hinge of the access door, so that refrigerators can be produced and operated more efficiently.

BRIEF DESCRIPTION OF THE INVENTION

As described herein, the exemplary embodiments of the present invention overcome one or more of the above or other disadvantages known in the art.

One aspect of the present invention relates to an ice making apparatus/refrigerator which includes an ice making compartment; an icemaker disposed in the ice making compartment and including an ice mold body, the ice mold body defining therein a plurality of ice cavities for containing water therein for freezing into ice cubes, and a channel for transport of a working medium for cooling the ice making compartment, the channel having an outlet; and a temperature sensor disposed in the ice making compartment and adjacent the outlet.

Another aspect relates to a refrigerator which includes a food storage compartment; an access door; a pair of hinges for rotatably mounting the access door relative to the food storage compartment so that the access door is operable to selectively close the food storage compartment; an ice making compartment mounted on the access door; an icemaker disposed in the ice making compartment; a water dispenser mounted on the access door; and a water supply unit for controlling supply of water to the icemaker and the water dispenser, the water supply unit including a main conduit extending into the access door through one of the hinges, and a valve disposed in the access door for diversion of water between the icemaker and the water dispenser.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

DETAILED DESCRIPTION OF THE EXEMPLARILY EMBODIMENTS OF INVENTION

Figure 1:
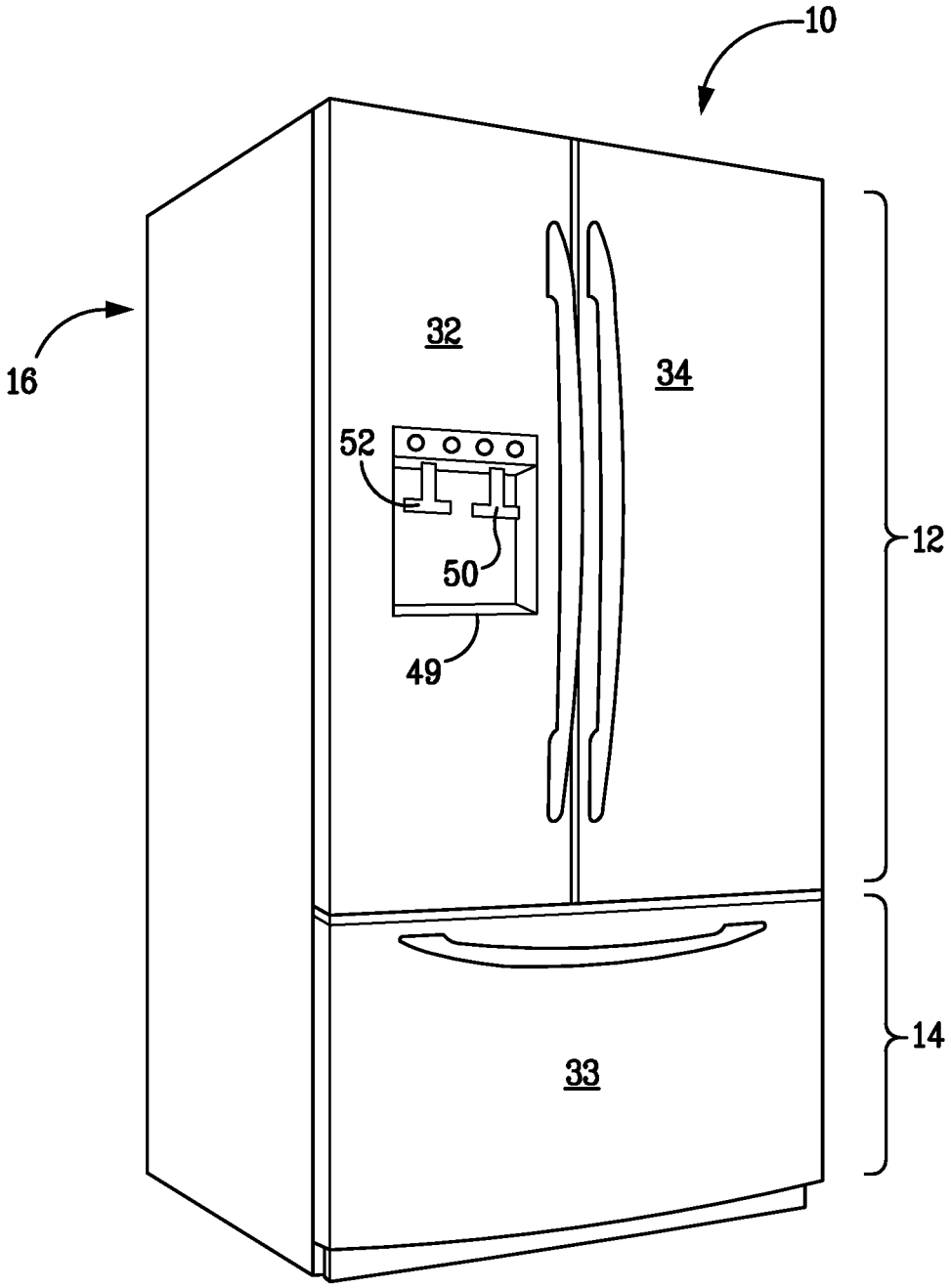
FIG. 1 is a perspective view of a refrigerator in accordance with an exemplary embodiment to the present invention.

FIG. 1 illustrates an exemplary refrigerator 10. While the embodiments are described herein in the context of a specific refrigerator 10, it is contemplated that the embodiments may be practiced in other types of refrigerators. Therefore, as the benefits of the herein described embodiments accrue generally to ice making apparatus and water control within the refrigerator, the description herein is for exemplary purposes only and is not intended to limit practice of the invention to a particular refrigeration appliance or machine, such as refrigerator 10.

On the exterior of the refrigerator 10, as seen in FIG. 1, there is an external recessed access area 49 to for dispensing of drinking water and ice cubes. Upon a stimulus, a water dispenser 50 allows an outflow of drinking water into a user's receptacle (not shown). Upon another stimulus, an ice dispenser 52 allows an outflow of ice cubes into a user's receptacle.

Figure 2:
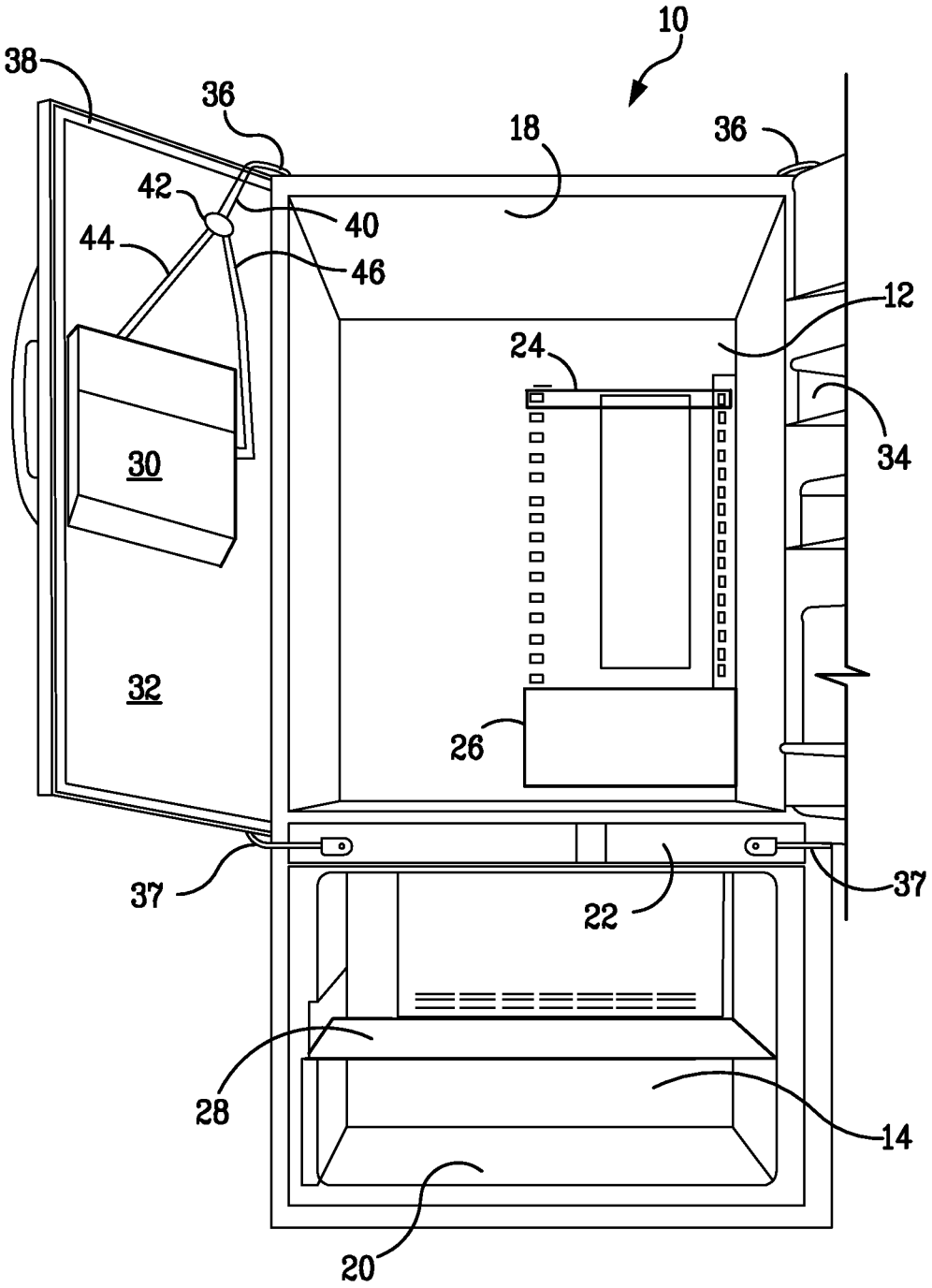
FIG. 2 is a perspective view of the refrigerator of FIG. 1 with the refrigerator doors being in open position and the freezer door being removed for clarity.

FIG. 2 illustrates the refrigerator 10 with its upper access doors in open position. Refrigerator 10 includes food storage compartments such as a fresh food compartment 12 and a freezer compartment 14. As shown, fresh food compartment 12 is located above freezer compartment 14 in a bottom mount refrigerator-freezer configuration. Refrigerator 10 includes an outer case 16 (as seen in FIG. 1) and inner liners 18 and 20 for compartments 12 and 14 respectively. A space between outer case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of the case. A bottom wall of outer case 16 normally is formed separately and attached to the side walls and to a bottom frame that provides support for refrigerator 10. Inner liners 18 and 20 are molded from a suitable plastic material to form fresh food compartment 12 and freezer compartment 14, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances.

The insulation in the space between the bottom wall of liner 18 and the top wall of liner 20 is covered by another strip of suitable resilient material, which also commonly is referred to as a mullion 22. Mullion 22 in one embodiment is formed of an extruded ABS material.

Shelf 24 and slide-out drawer 26 can be provided in fresh food compartment 12 to support items being stored therein. A combination of shelves, such as shelf 28, can be provided in freezer compartment 14.

Left side fresh food compartment door 32, right side fresh food compartment door 34, and a freezer door 33 close access openings to fresh food compartment 12 and freezer compartment 14, respectively. In one embodiment, each of the doors 32, 34 is mounted by a top hinge assembly 36 and a bottom hinge assembly 37 to rotate about its outer vertical edge between a closed position, as shown in FIG. 1, and an open position, as shown in FIG. 2. Fresh food compartment doors 32 and 34 each include a sealing gasket 38 which can be seen in FIG. 2 on the left side fresh food compartment door 32. Freezer door 33 also includes a sealing gasket (not shown) on its interior face.

An ice making compartment 30 can be seen, in one embodiment, on the interior of left side fresh food compartment door 32. One main supply line or conduit 40, which passes through the respective top hinge assembly 36 in this particular embodiment, reaches a valve 42, where the flow of water through the main supply line 40 is controlled. The main supply line 40 is described herein as passing through top hinge assembly 36 for exemplary purposes, as it may pass through either a top hinge or bottom hinge assembly.

Valve 42 controls the flow of water to the icemaker line 44 and the water dispenser line 46. The provision of a single main supply line 40 solves the concern of having more than one delivery line pass through the hinge assembly, making the hinge assembly simpler and designed to be more reliable.

The valve 42 can be designed and controlled in several ways. For example, in one embodiment, the valve 42 is configured so that in a first operation position, it can supply water to both the icemaker 30 through the water delivery line or conduit 44 and to the water dispenser 50 through the water delivery line or conduit 46. Alternatively or additionally, the valve 42 is configured so that in another operation positions, it can supply water to the water dispenser 50 through the water delivery line 46, or to the icemaker 30 through the water delivery line 44, but not to both at the same time. When there is a conflicting demand, the valve 42 supplies water to the water dispenser 50 or the icemaker 30, depending on the predetermined setting. In another embodiment, the valve 42 can be within the left side fresh food compartment door 32.

Figure 3:
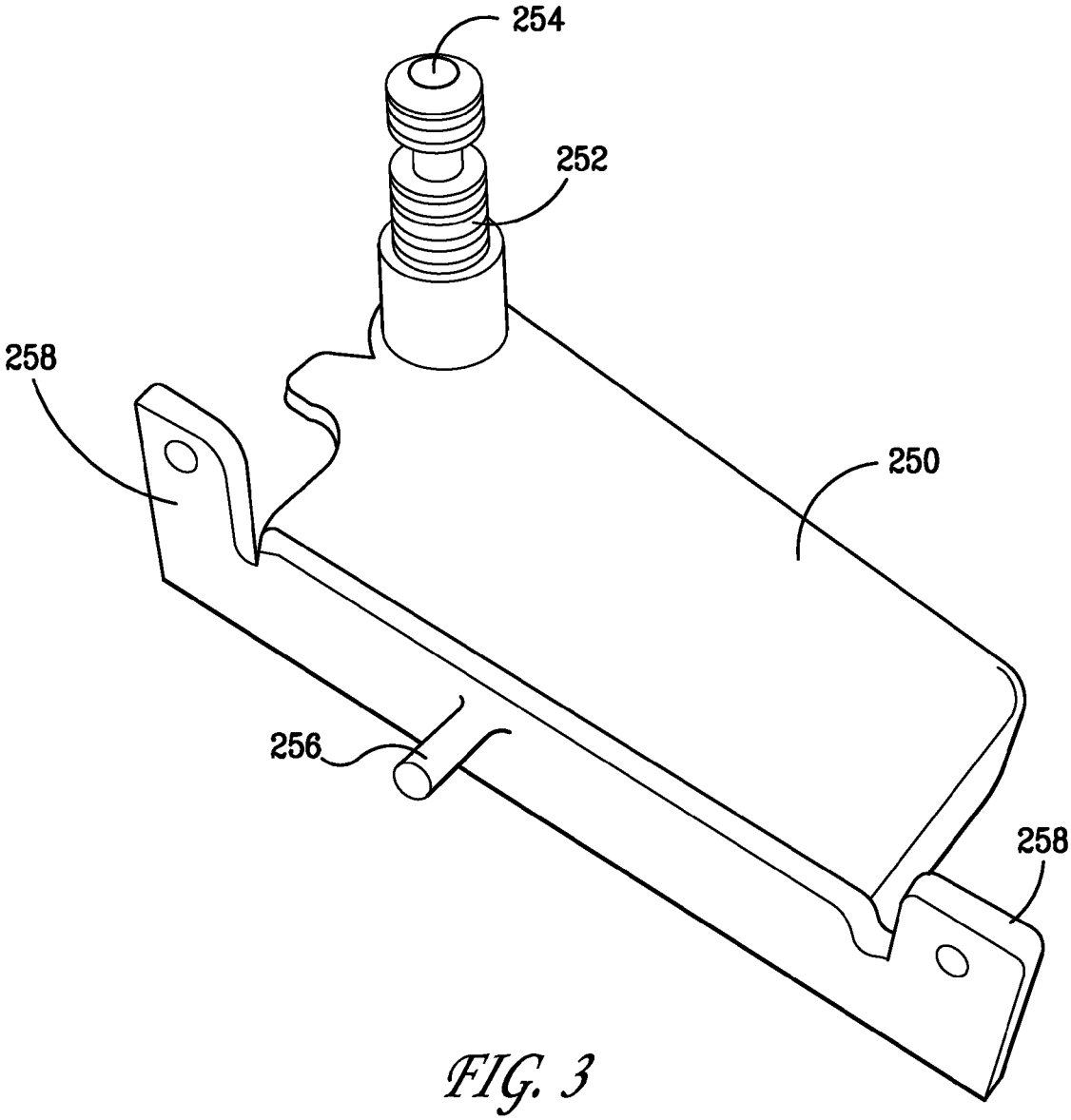
FIG. 3 is a perspective view of an exemplary hinge assembly that can be used in the refrigerator of FIG. 1.
Figure 4:
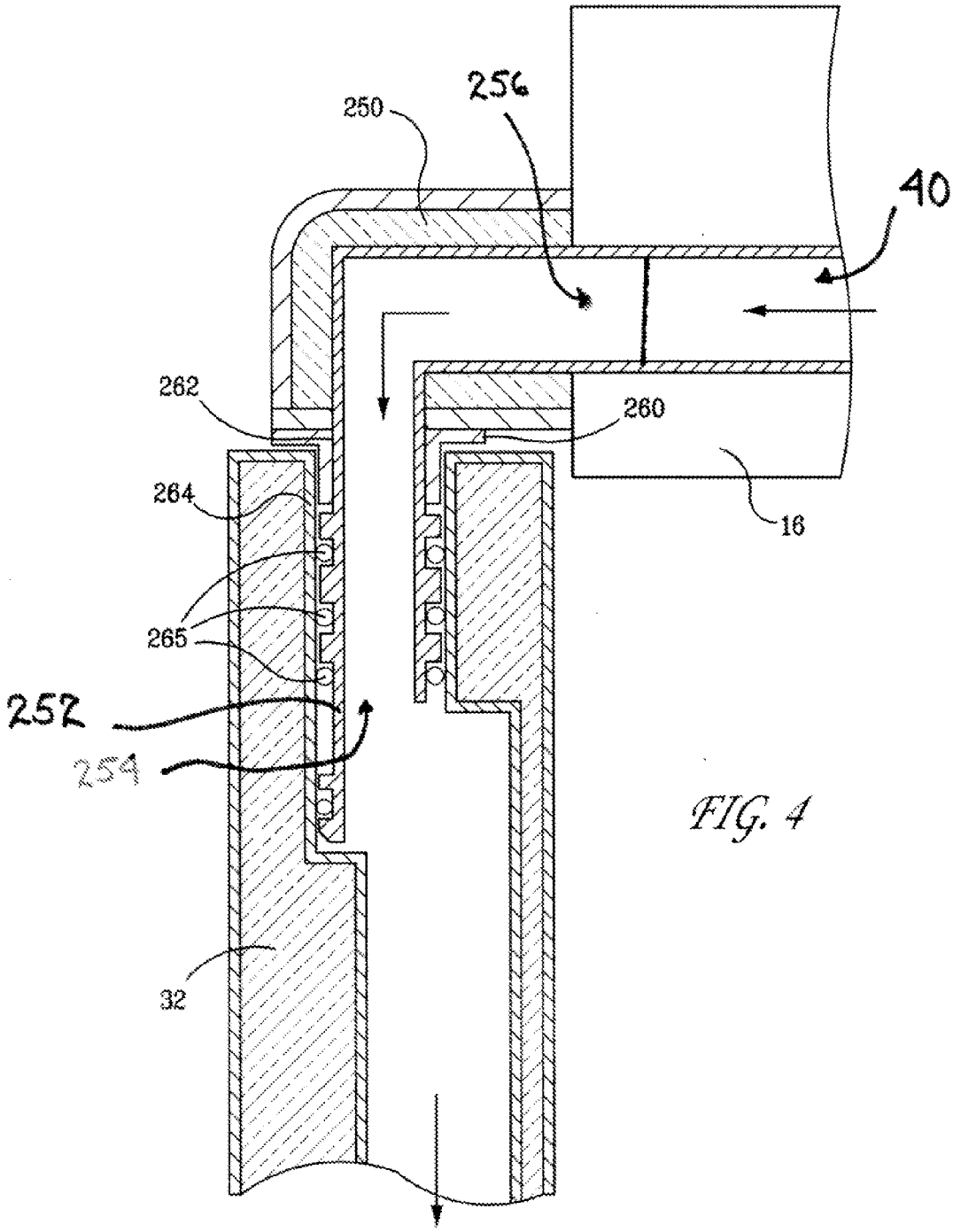
FIG. 4 is an enlarged, schematic view, showing how the hinge assembly is used.

For illustrative purposes, FIGS. 3 and 4 demonstrate a hinge assembly, which may be used to pass a single delivery of potable water to the icemaker and drinking water dispenser. This illustrative example is by no means meant to exemplify the only hinge configuration that could be used to pass a single delivery of potable water. For illustrative purposes, the hinge assembly is described as the top hinge assembly, but may be the bottom hinge in another embodiment.

As shown in FIG. 3, the top hinge assembly includes a body 250 and a substantially round hinge manifold 252, which extends outwardly from the interior of the body 250, and contains a single supply conduit 254 which is the source of the potable water that supplies the main supply line 40 as seen in FIG. 2. The body 250 includes a water inlet 256 which extends substantially horizontally from the interior of the body 250 and is in fluid communication with the supply conduit 254.

The top hinge assembly is fixed to the outer casing 16 through a pair of fixing supports 258 arranged at the ends of the hinge assembly. For example, the supports 258 can be attached to the outer case 16. Once the top hinge assembly is affixed to the outer case 16, the inlet 256 is inserted into a complementary receiving cavity (not shown) formed in the outer case 16, and further in communication with corresponding conduits (not shown) formed in the body/chassis of the refrigerator for the purpose of delivering water from the exterior household water supply line.

FIG. 4 illustrates the body 250 of the hinge assembly 36 which includes a hinge member or bearing 260 disposed, in one embodiment, on top of the left side fresh food compartment door 32. For example, the hinge member 260 can be made of a material with less friction such as steel. It should be recognized that any suitable material is applicable. A through hole 262 is formed in the hinge member 260 to allow the hinge manifold 252 to extend downwardly from the body 250. The hinge manifold 252 is insertable into a substantially complementary door manifold 264 formed in the left side fresh food compartment door 32. The hinge manifold 252 and the door manifold 264 are dimensioned to provide a suitable tight engagement using o-ring seals 265, which is able to prevent fluid from leaking out. Once the hinge manifold 252 is inserted into the door manifold 264, the left side fresh food compartment door 32 is rotatable around the hinge manifold 252 as an axis.

Figure 5:
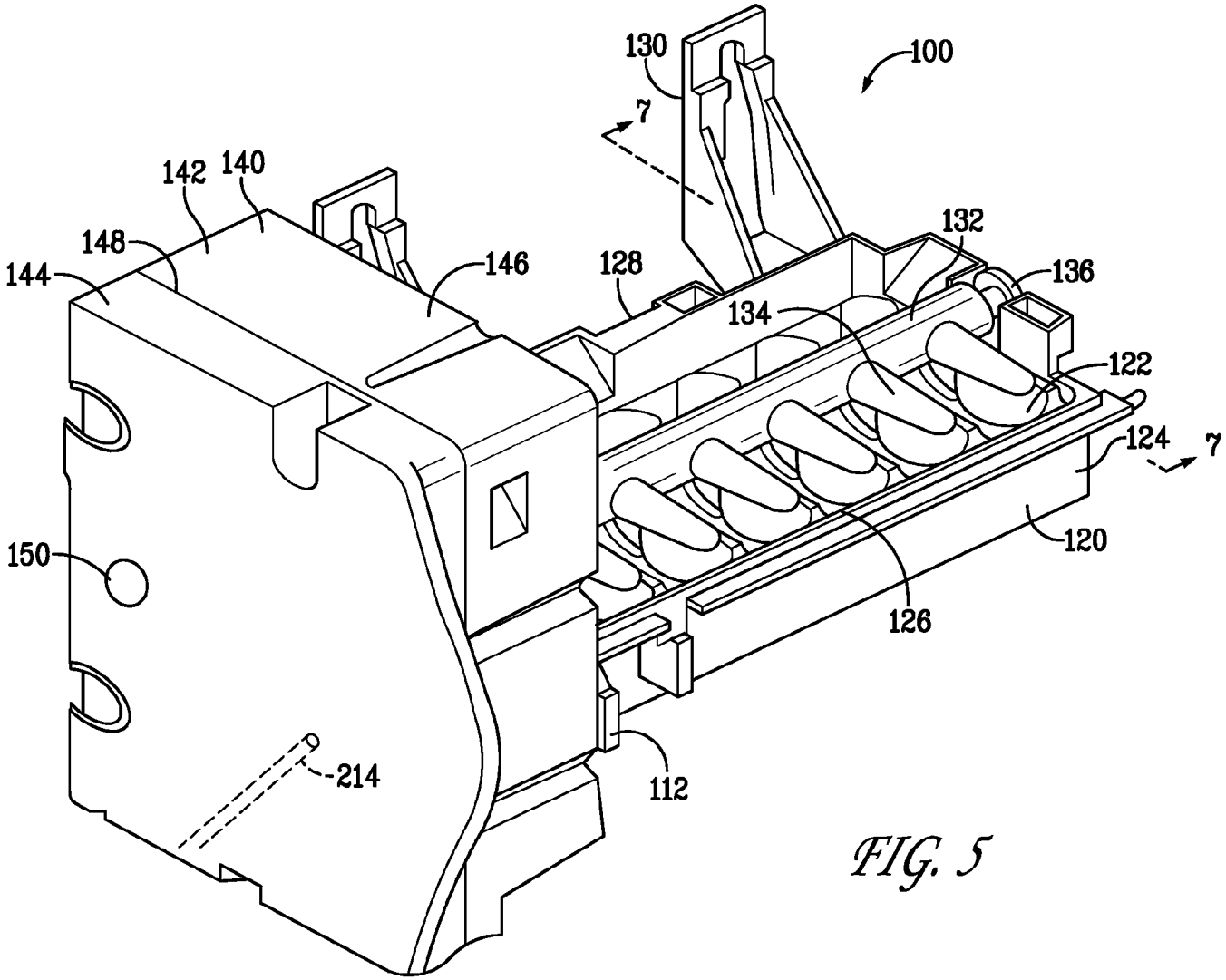
FIG. 5 is a perspective view of the icemaker of FIG. 1.

FIG. 5 is a perspective view of icemaker 100 illustrating mold body 120 and control housing 140. Mold body 120 includes an open top 122 extending between mounting end 112 and a free end 124 of mold body 120. Mold body 120 also includes a front face 126 and a rear face 128. Front face 126 is substantially aligned with ice storage bin 240 (shown in FIG. 7) when icemaker 100 is mounted within ice making compartment 30 such that ice cubes or pieces 242 are dispensed from mold body 120 at front face 126 into ice storage bin 240. Rear face 128 faces the exterior of, in one embodiment, the face of the left side fresh food compartment door 32. In one embodiment, brackets 130 extend upward from rear face 128.

The ice making compartment 30 must be cooled by a working medium, which is in turn cooled by at least one temperature control circuit of the refrigerator 10. The temperature control circuit can be a conventional vapor-compression refrigeration circuit. The vapor-compression refrigeration circuit is known in the art, and therefore will not be discussed in detail here. When the working medium is air, the temperature control circuit cools the air in the freezer compartment 14 to a predetermined temperature, and the cooled air is then supplied to the ice making compartment 30 from the freezer compartment 14 through a supply air duct and then returned to the freezer compartment 14 through a return air duct.

Figure 3A:
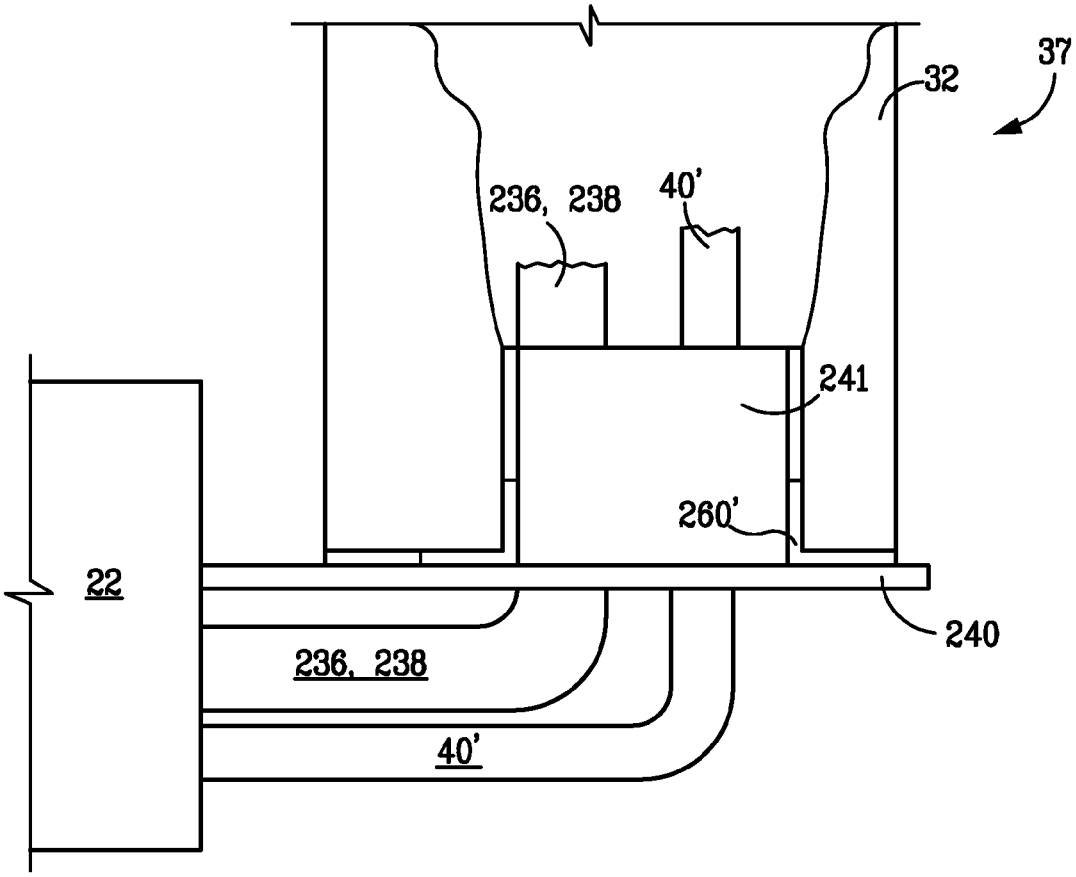
FIG. 3A shows another exemplary hinge assembly.
Figure 6:
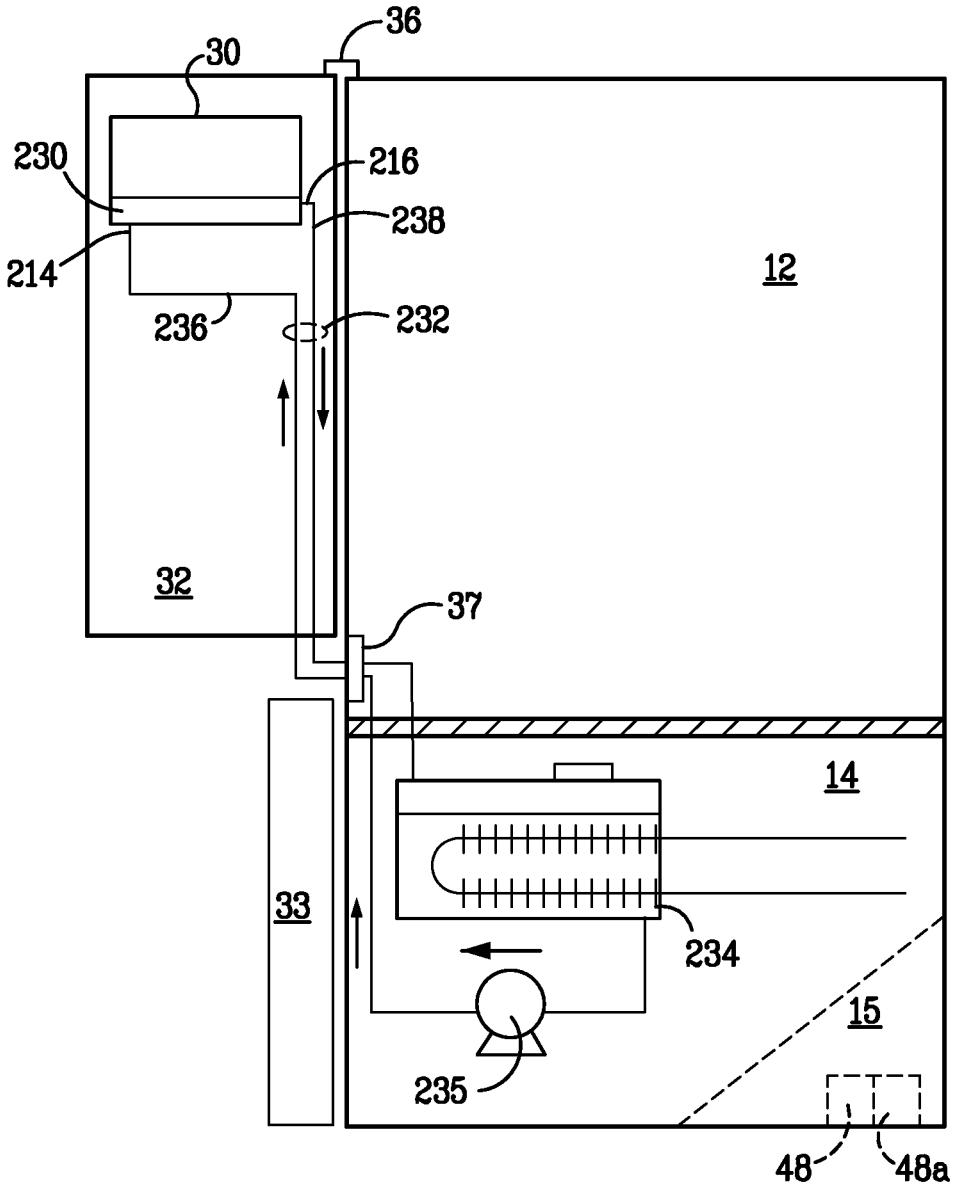
FIG. 6 is a schematic, right side view of the refrigerator of FIG. 1.

As illustrated in FIG. 6, when the working medium is a liquid, such as a food safe liquid in the nature of a mixture of propylene glycol and water, a second temperature control circuit 232 is used. The second temperature control circuit 232 includes a first heat exchanger 234 disposed in the freezer compartment 14, a second heat exchanger 230 mounted in the ice making compartment 30 and thermally coupled to or being part of the mold body defining the ice cavities, a supply conduit 236 and a return conduit 238 between the first and second heat exchangers 234, 230, and a pump 235 for circulating the working medium within the second temperature control circuit 232. The working medium is cooled when it passes through the first heat exchanger 234. The pump 235 forces the cooled working medium to pass through the second heat exchanger 230 to keep the temperature of the ice making compartment 30 and/or the ice mold body 120 below the freezing point of water. The second temperature control circuit 232 is discussed in greater detail in commonly owned application Ser. No. 11/958,900, filed Dec. 18, 2007, the entire content of which is incorporated herein by reference. As shown in FIG. 6, both the supply conduit 236 and the return conduit 238 pass through the low hinge 37. FIG. 3A shows an exemplary bottom hinge assembly 37 where both the conduits 236, 238 for the working medium (only one conduit is shown for conduits 236, 238 in FIG. 3A because a multi-lumen tube is used here) and the main water supply line 40' pass through the bottom hinge assembly 37. In this embodiment, the hinge plate 240 is attached to the outer case 16 of the refrigerator. The hinge plate 240 has a through hole (not shown). A hinge tube 241 extends upward from the hinge plate 240 and covers the hole. The hinge tube 241 is inserted into a cavity formed in the lower portion of the left side fresh food compartment door 32 so that the door 32 is rotatable relative to the fresh food compartment 12 around the hinge tube 241. Bearing 260' is preferably disposed between the door 32 and the hinge plate 240.

Referring again to FIG. 5, rake 132 extends from control housing 140 along open top 122 of mold body 120. Rake 132 includes individual fingers 134 received within the ice cavities of mold body 120. In operation, rake 132 is rotated about an axis of rotation or rake axis 136 that extends generally parallel to front face 126 and rear face 128. A motor (not shown) is housed within control housing 140 and is used for turning or rotating rake 132 about the axis of rotation 136.

In the exemplary embodiment, control housing 140 is provided at mounting end 112 of mold body 120. Control housing 140 includes a housing body 142 and an end cover 144 attached to housing body 142. Housing body 142 extends between a first end 146 and a second end 148. First end 146 is secured to mounting end 112 of mold body 120. Alternatively, housing body 142 and mold body 120 are integrally formed. The end cover 144 is coupled to second end 148 of housing body 142 and closes access to housing body 142. In an alternative embodiment, end cover 144 is integrally formed with housing body 142. Housing body 142 houses the motor and/or a controller (not shown). An input 150 for an external power supply unit 48 can be formed through the end cover 144 or alternatively through housing body 142.

The power supply unit 48 (shown in FIG. 6) is external to the ice making compartment 30, allowing for more space within the ice making compartment 30 and a more efficient ice making process with very little if any additional heat applied to the interior of the ice making compartment 30. This additional space and more efficient ice making process allows for faster ice production rate and an overall more efficient system. When a DC motor is used to rotate rack 132, the power supply unit 48 includes an AC-DC converter 48*a*. In one embodiment, the power supply unit 48 is positioned remotely from the ice making compartment 30. More specifically, the power supply unit 48 can be located outside of the refrigerator casing, within the refrigerator casing, or within the refrigerator casing but outside of the fresh food and freezer compartments. However, preferably the power supply unit 48 is disposed in the mechanical compartment 15 of the refrigerator 10.

Figure 7:
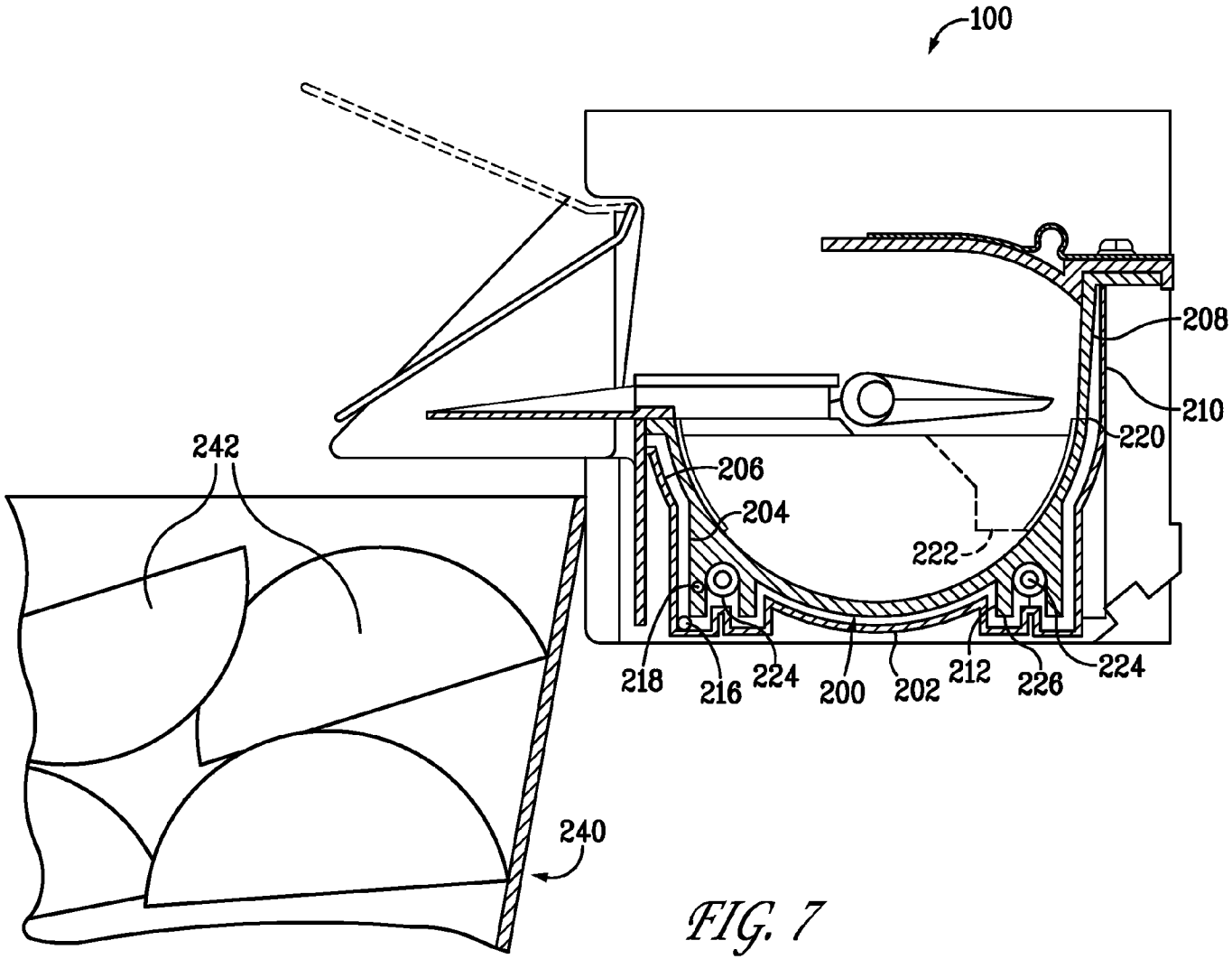
FIG. 7 is a cross sectional view of the icemaker of FIG. 5, along with an ice storage bin.

FIG. 7 is a cross sectional view of ice maker 100 including a mold body 120 with a tray structure having a bottom inner wall 200, a bottom outer wall 202, a front inner wall 204, a front outer wall 206, a rear inner wall 208 and a rear outer wall 210. The inner and outer walls of the mold body 120 form a channel 212 through which a coolant can pass. An inlet 214 (shown in FIG. 5) allows coolant to flow into channel 212 by passing through the mounting end 112 of the apparatus as seen in FIG. 5. An outlet 216 allows a coolant to flow out of channel 212. The portion of the mold body 120 that defines the channel 212 functions as the second heat exchanger 230 shown in FIG. 6. Preferably, a temperature sensor such as a thermistor 218 or a resistive temperature device is adjacent to and in thermal connection with outlet 216 and in this embodiment is shown to be connected to the inner front wall 204. In other embodiments, thermistor 218 can also be connected to the coolant outlet of the channel, or to the ice cube cavity which is closest in proximity to the channel outlet 216. Thermistor 218 is so positioned to detect system temperature near the channel outlet, giving a more accurate reflection of the thermodynamic variables within the ice making compartment 30/icemaker 100. The position of thermistor 218 allows for more assurance that all cubes within ice mold body 120 are fully frozen, not just the cubes in close proximity to the channel inlet 214.

A plurality of partition walls 220 extend transversely across mold 120 to define a plurality of ice cavities in which ice cubes 242 can be formed. Each partition wall 220 includes a recessed upper edge portion 222 through which water flows successively through each cavity to fill mold 120.

In this embodiment, two sheathed electrical resistance ice removal heating elements 224 are press-fit, staked, and/or clamped into bottom support structure 226 of mold body 120 and heats mold body 120 when a harvest cycle begins to slightly melt ice cubes 242 and release them from the ice cavities. Rotating rake 132 sweeps through mold body 120 as ice cubes are harvested and ejected from mold body 120 into ice storage bin or bucket 240. Cyclical operation of heating elements 224 and rake 132 are effected by a controller (not shown), which also automatically provides for refilling mold body 120 with water for ice formation after ice is harvested through communication with water valve 42 (shown in FIG. 2) which is connected to water delivery line 40 and delivers water to mold body 120 through an inlet structure (not shown).

Thus, while there have shown, described and pointed out fundamental novel features of the invention as applied to various specific embodiments thereof, it will be understood that various omissions, substitutions and changes in the form and details of the devices illustrated and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A refrigerator comprising:

an ice making compartment;

an access door, wherein the ice making compartment is on the access door;

an icemaker disposed in the ice making compartment and comprising an ice mold body, the ice mold body defining therein a plurality of ice cavities for containing water therein for freezing into ice cubes, and a channel for transport of a liquid coolant for cooling the mold body, the channel having an outlet; and a temperature sensor disposed in the ice making, compartment and adjacent the outlet of the channel for transport of the liquid coolant.

2. The refrigerator of claim 1, wherein the temperature sensor is operatively connected to the outlet.

3. The refrigerator of claim 1, wherein one of the ice cavities is disposed in closest proximity to the outlet, the temperature sensor being operatively connected to the one of the ice cavities.

4. The refrigerator of claim 1, wherein the temperature sensor comprises a thermistor or a resistive temperature device.

5. The refrigerator of claim 1, further comprising a power supply unit for powering the icemaker, the power supply comprising an AC-DC converter and being disposed remote from the ice making compartment.

6. The refrigerator of claim 5, further comprising a fresh food compartment and a freezer compartment, the power supply unit being disposed outside of the fresh food compartment and the freezer compartment.

7. The refrigerator of claim 6, further comprising a mechanical compartment, the power supply unit being disposed in the mechanical compartment.

8. The refrigerator of claim 6, further comprising a casing, the power supply unit being disposed in the casing.

9. The refrigerator of claim 1, further comprising:

a food storage compartment, wherein the access door is for access to the food storage compartment a pair of hinges for rotatably mounting the access door relative to the food storage compartment so that the access door is operable to selectively close the food storage compartment;

a water dispenser mounted on the access door; and a water supply unit for controlling supply of water to the icemaker and the water dispenser, the water supply unit comprising a main conduit extending into the access door through one of the hinges.

10. The refrigerator of claim 9, wherein the main conduit comprises a first portion for carrying water from the water supply unit to the hinge and a second portion for carrying water from the hinge to the icemaker and the water dispenser, the hinge fluidly coupling the first portion and the second portion, the hinge comprising a water inlet for connecting to the first portion and a hinge manifold with a supply conduit that connects to the second portion of the main conduit.

11. The refrigerator of claim 9, wherein the one of the hinges comprises:

a body;

an inlet extending horizontally from the body and in fluid communication with the water supply; and a hinge manifold extending outwardly from an interior of the body, a supply conduit in the hinge manifold providing the supply of water to the icemaker and the water dispenser;

the hinge manifold being rotatably received in a complimentary door manifold in the access door, the access door rotating around the hinge manifold as an axis.

12. The refrigerator of claim 9, wherein the water supply unit further comprises a valve disposed in the access door for diversion of water between the icemaker and the water dispenser.

13. The refrigerator of claim 12, wherein the valve is disposed within a structure of the access door.

14. The refrigerator of claim 12, wherein the water supply unit further comprises a first delivery conduit extending from the valve to the icemaker, and a second delivery conduit extending from the valve to the water dispenser.

15. The refrigerator of claim 12, wherein the valve diverts water to the icemaker when there is water demand from the icemaker, and diverts water to the water dispenser when there is water demand from the water dispenser.

16. The refrigerator of claim 15, wherein the valve diverts water to the water dispenser when there is water demand from the water dispenser regardless whether there is water demand from the icemaker.

17. An ice making apparatus for a refrigerator, comprising:

an ice making compartment;

an access door, wherein the ice making compartment is on the access door;

an icemaker disposed in the ice making compartment and comprising an ice mold body, the ice mold body defining therein a plurality of ice cavities for containing water therein for freezing into ice cubes, and a channel for transport of a liquid coolant, the channel having an outlet; and a temperature sensor disposed in the ice making compartment and adjacent the outlet of the channel for transport of the liquid coolant.

18. A refrigerator comprising:

a food storage compartment;

an access door;

a pair of hinges for rotatably mounting, the access door relative to the food storage compartment so that the access door is operable to selectively close the food storage compartment;

an ice making, compartment mounted on the access door;

an icemaker disposed in the ice making compartment;

the icemaker including a channel for transport of a liquid coolant for cooling the icemaker;

a water dispenser mounted on the access door; and a water supply unit for controlling a supply of water to the icemaker and the water dispenser, the water supply unit comprising a main conduit, a first portion of the main conduit extending into the access door and to a hinge of the access door, a second portion of the main conduit extending away from the hinge, wherein the hinge fluidly couples the first and second portions of the main conduit, and comprises:

a water inlet and a hinge manifold, a supply conduit disposed within the hinge manifold, the water inlet connecting to the first portion of the main conduit and the supply conduit connecting to the second portion of the main conduit, and a valve disposed in the access door and coupled to the second portion of the main conduit for diversion of water between the icemaker and the water dispenser.

19. The refrigerator of claim 18, wherein the water inlet extends horizontally from a body of the hinge and is in fluid communication with the water supply, and the hinge manifold extends outwardly from an interior of the body of the hinge.

20. The refrigerator of claim 18, wherein the access door comprises a complimentary door manifold for rotatably receiving the hinge manifold, the access door being configured to rotate around the hinge manifold as an axis.

* * * * *

UNITED STATES PATENT AND TRADEMARK OFFICE

CERTIFICATE OF CORRECTION

PATENT NO. : 8,499,577 B2
APPLICATION NO. : 12/333749
DATED : August 6, 2013
INVENTOR(S) : Watson et al.

It is certified that error appears in the above-identified patent and that said Letters Patent is hereby corrected as shown below:

In the Claims

In Column 7, Line 43, in Claim 1, delete “ice making,” and insert -- ice making --, therefor.

In Column 8, Line 3, in Claim 9, delete “compartment” and insert -- compartment; --, therefor.

In Column 9, Line 1, in Claim 18, delete “mounting,” and insert -- mounting --, therefor.

In Column 9, Line 5, in Claim 18, delete “making,” and insert -- making --, therefor.

Signed and Sealed this
First Day of December, 2015

Michelle K. Lee

Michelle K. Lee
*Director of the United States Patent and Trademark Office*